United States Patent [19]

Greene

[11] 4,013,543

[45] Mar. 22, 1977

[54] UPGRADING SOLID FUEL-DERIVED TARS PRODUCED BY LOW PRESSURE HYDROPYROLYSIS

[75] Inventor: Marvin Greene, Somerset, N.J.

[73] Assignee: Cities Service Company, Tulsa, Okla.

[22] Filed: Dec. 15, 1975

[21] Appl. No.: 640,619

Related U.S. Application Data

[63] Continuation-in-part of Ser. No. 623,692, Oct. 20, 1975, Pat. No. 3,997,423.

[52] U.S. Cl. ..... 208/50; 208/8; 208/142

[51] Int. Cl.[2] ..... C10B 55/00

[58] Field of Search ..... 208/8, 11 R, 127, 142, 208/50; 201/31, 39

[56] References Cited

UNITED STATES PATENTS

| | | | |
|---|---|---|---|
| 3,018,242 | 1/1962 | Gorin | 208/8 |
| 3,030,297 | 4/1962 | Schroeder | 208/8 |
| 3,111,395 | 11/1963 | Sweeney | 208/8 |
| 3,261,775 | 7/1966 | Blaser | 208/11 R |
| 3,839,186 | 10/1974 | Berger | 208/8 |
| 3,855,070 | 12/1974 | Squires | 208/8 |

*Primary Examiner*—Delbert E. Gantz
*Assistant Examiner*—James W. Hellwege
*Attorney, Agent, or Firm*—John W. Carpenter; Donald L. Traut; George L. Rushton

[57] ABSTRACT

Crushed carbonaceous fuel is rapidly mixed with hot hydrogen, at 500° to 1,500° C. and 0 to 250 psig., in a reactor, and then, after a short reaction time, rapidly quenched. The total heat-up, reaction, and quench time is less than 2 seconds. This short residence time and rapid heat-up results in a high yield of carbonaceous tars. The carbonaceous tars are subsequently and directly introduced into a fluid coker to obtain gas, upgraded carbonaceous tars, and hot coke.

9 Claims, No Drawings

UPGRADING SOLID FUEL-DERIVED TARS PRODUCED BY LOW PRESSURE HYDROPYROLYSIS

This is a continuation-in-part application of my copending application Ser. No. 623,692, filed Oct. 20, 1975 now U.S. Pat. No. 3,997,423.

BACKGROUND OF THE INVENTION

1. Field of the Invention

This invention is related to carbonaceous tars. More particularly, this invention concerns a method of producing and upgrading coal tars which have been produced from a process for treating coal with hydrogen, in the absence of any added catalyst and/or solvent.

2. Description of the Prior Art

Processes for treating coal with hydrogen have been known for many years. Prior art references include U.S. Pat. Nos. 2,658,861; 2,832,724; 3,030,297; and 3,152,063. Typically, these processes have mixed crushed coal with various solvents, with or without added catalyst, and have heated the mixture to reaction temperature, for an extended period of time, in the presence or absence of hydrogen. Such processes have generally given a wide range of products, from gases to light hydrocarbons to high-boiling liquids, in addition to the solid residues. For example, U.S. Pat. No. 3,823,084, issued to W. C. Schroeder on July 9, 1974 discloses mixing coal and hydrogen, in the absence of a solvent, passing the mixture through a bed of hydrogenation catalyst, and recovering liquid and gaseous hydrocarbon products from the product stream. The disadvantages of such processes include addition of a catalyst that will survive the severe reaction conditions, removal of the catalyst from the effluent stream, recovery of a broad spectrum of gaseous, low-boiling and high-boiling liquids, the necessity for solvent addition and removal, and additional processing steps to separate, remove and recycle various portions of the reaction stream.

In my previously copending application (Ser. No. 623,692, filed Oct. 20, 1975), I devised a low pressure (atmospheric pressure-250 psia) process for treating carbonaceous materials with hydrogen, in the absence of added catalyst, to produce a high yield of carbonaceous tars. The carbonaceous tars produced by my process are difficult to refine using conventional catalytic technology. Their excessive metals content, free radical content and Conradson Carbon content essentially render conventional catalysts and catalytic hydrotreating processes ineffective.

SUMMARY OF THE INVENTION

I believe that I have overcome, or greatly reduced, the disadvantages of prior art processes of my process of producing and upgrading carbonaceous tars comprising the serial steps of (a) adding liquid or crushed solid carbonaceous material to a reactor, (b) adding hot hydrogen to the stream of carbonaceous material, (c) reacting the hydrogen and the carbonaceous material between atmospheric pressure and 250 psia, (d) quenching the mixture with the total residence time varying from about 2 milliseconds to about 2 seconds, and (e) introducing the quenched mixture of step (d) directly into a fluid coking zone to obtain gas, upgraded carbonaceous tars, and hot coke. In a narrower aspect, the invention concerns a method of producing and upgrading coal tars, comprising the steps of (a) introducing finely divided coal into a pressure vessel in a continuous stream, and at a pressure between atmospheric pressure and 250 psia, (b) continuously adding hot hydrogen to the pressure vessel so as to impinge and heat said coal stream, (c) limiting contact between the hot hydrogen and the coal stream within the vessel to a period of less than 2 seconds, (d) quenching the hot hydrogen-coal stream with cold hydrogen, within the reactor, (e) separating coal tars from the quenched hydrogen-coal stream, and (f) introducing the coal tar vapors of step (e) directly into a fluid coking zone to obtain gas, upgraded coal tars and hot coke. The upgraded coal tar stream can then be processed to hydrorefining units. The heart of the invention resides in upgrading carbonaceous or coal tars by fluid coking after a short total residence time of the carbonaceous material in the liquefaction reactor, at a low pressure between about atmospheric pressure and 250 psia, with a residence time less than 2 seconds including heat-up, reaction, and quench times, and coal heat-up rates in excess of 500° C/sec. This short residence time contrasts sharply with other hydrogenation processes involving catalysts, solvents, and high pressure wherein relatively long residence times are involved and the reaction mixture is quenched outside the reactor.

My process, involving, at low pressure, short heat-up and quench times, results in improved yields of desirable tar products, for upgrading with fluid coking, no problems of catalyst addition or removal, simplified apparatus, and improved process reliability.

DETAILED DESCRIPTION OF THE INVENTION

Feed material for the process broadly includes carbonaceous material, exemplified by coal, lignite, peat, oil shale, tar sands, organic waste, Orinoco tar, gilsonite, and crude oil. A preferred embodiment of the invention uses coal as the solid feed material. It is noted that all of these feed materials, except conventional crude oil, are solids at ambient temperatures.

The solid feed material is crushed to a particle size of less than 1 inch. It is preferred that the particle size be less than about one-half inch, and the most preferred particle size is in the range of 50 to 200 mesh (U.S. Sieve).

The process can utilize almost any hydrogen stream as long as the hydrogen content of the stream is sufficient to react with the carbonaceous material and does not contain deleterious components. Broadly, the incoming hydrogen stream can vary from about 30% hydrogen to about 100% hydrogen, based on the partial pressure of hydrogen. Since recycle of a portion of the effluent gas stream is contemplated in the process, the reactant hydrogen stream can also contain components such as methane, propane, and ethane, with these components typically not condensing as they are cooled to quench temperatures.

Since the process involves the mixing and reaction of carbonaceous material and feed hydrogen, the hydrogen-to-carbonaceous material weight ratio is an important consideration. Broadly, this weight ratio can vary from about 0.005 to about 4, with the higher value showing an excess of hydrogen and the lower value resulting in the formation of more char, with reduced amounts of desirable product. A more desirable hydrogen-to-carbonaceous material weight ratio is in the range of from about 0.05 to about 2, and the most preferred ratio is from about 0.1 to about 1.2.

Since an important aspect of this invention resides in the rapid heating and cooling of the reactants and reaction mixture, at low pressure (0 psig–250 psig), respectively, the temperature of the incoming reactants is of some importance. Typically, the temperature of the incoming carbonaceous material is desirably ambient. It is recognized that, due to conduction, radiation and convection from the hot reactor, the incoming feed material may be heated somewhat. Any tendency to over-heat the material to near-reaction temperatures can be reduced by various designs to cool the feed material or to move it at such a rate that it does not have time to be heated appreciably.

Prior art processes raise the temperature of the reactants comparatively slowly, such as by using preheaters for the reacting mixture or by heating the reactor externally. My process is based on heating the reactant hydrogen to above the reaction temperature and then rapidly impinging this hot hydrogen onto the incoming carbonaceous feed material, within the reactor.

The temperature of the incoming hot hydrogen will vary somewhat, depending on the desired hydrogen-to-carbonaceous material weight ratio of the reactant mixture and upon the desired reaction temperature in the reactor. Typically the inlet hydrogen temperature should be approximately 50° C. higher than the reaction temperature, when the hydrogen-to-carbonaceous material ratio is around 1, with this temperature difference resulting in a rapid heat-up time greater than about 500° C. per second.

Cooling coils may be combined with the mechanical arrangements to reduce the tendency to pre-heat the incoming carbonaceous material. Similarly, the pressure of the incoming hydrogen will exceed that of the reactor. The combination of a slight excess of incoming hydrogen pressure and the weight of the incoming carbonaceous material results in a continuous mass flow of reactants through the reactor.

The reaction temperature can vary from about 400° to about 2,000° C., with a preferable range being from about 500° to about 1,500° C., and a most preferred range of from about 600° C. to about 1000° C. The reactor pressure can vary from about 0 to about 250 psig, preferably from about 15 to 150 psig. The total residence time of the reactants in the reactor can vary from about 2 milliseconds to about 2 seconds, preferably from about 5 milliseconds to about 1 second, with a most preferred residence time of from 10 milliseconds to about 900 milliseconds.

This total residence time includes the heat-up, reaction and quench times. Since there is reaction between the carbonaceous material and feed hydrogen as soon as the feed materials enter the reactor and are mixed, and since this reaction continues until the quenched mixture exits the reactor, it is difficult to separate the various phases of the total residence time. It is implicit in the invention that the rates of heat-up and quench be rapid. Direct or indirect quench can be used. The heat-up rate of the carbonaceous material is preferably between about 500° C/sec. and 1,000,000° C/sec.

The quench material added directly can be, broadly, any of a wide variety of gases or liquids that can be added quickly to the reactant mixture in order to cool the mixture below the effective reacting temperature, while the mixture is in the reactor. Materials that are non-reactive with the reactant mixture are preferred, but many common materials can be used. These can include a portion of the recycled gas stream from the process (having components such as methane, ethane, propane), inert gases such as helium or argon, and even such materials as water, nitrogen and $CO_2$. Although these latter materials can react at the temperatures found in the reactor, it is understood that these materials can be added to the reactant stream, from the recycle gas stream, at such a temperature and in such volume so that the result is a quenching of the reactant stream, rather than additional reaction between the reactant stream and the quenched material. Hydrogen is thus the preferred quench material, with a process recycle stream rich in hydrogen being a natural extension of the preferred embodiment. Depending upon the reaction temperature and the mass flow through the reactor, a sufficient amount of quenching material, at a suitable temperature, is added to the reactant stream so that the resultant mixture, near the exit of the reactor, has a temperature of about 200°–1200° C. The temperature and the amount of quenched material added are sufficient to quench the reactor mixture rapidly. Desirably, the quench temperature should be below the effective reacting temperature of the components, yet should be high enough to allow for the direct introduction of carbonaceous tar vapors into the fluid coker.

The weight ratio of quench material to product stream is dependent upon such factors as the reaction temperature, components of product stream, excess of hydrogen, and other conditions. Quenching is a function of the sensible heat in the reaction mixture and in the quench stream.

After the quenched reaction mixture departs the reactor, any unreacted solid material, such as ash or char, enters the char pot and is recovered therefrom, while the remainder of the effluent stream, typically predominantly containing coal tars, proceeds to downstream processing units.

It has been discovered that the coal tars produced are difficult to refine using conventional catalytic technology. The excessive metals content, free radical content and Conradson Carbon content essentially render conventional catalysts and catalytic hydrotreating processes ineffective.

I have discovered that an excellent way in which to improve the overall refining of coal-liquids to usable fuel and chemical products is by fluid coking of the coal tars directly after the liquefaction step and prior to hydrorefining steps. The cost of the fluid coking step followed by hydrorefining (both capital and operating costs) is far less than the total cost of merely directly hydrorefining of the coal liquids as produced from the liquefaction reactor of my copending application. Some of the advantages, differences in costs, and operability of using a fluid coking pretreater prior to hydrorefining are as follows: much improved hydrorefining catalyst life; non-catalytic whereas conventional pretreating processes are catalytic and coke is deposited on the catalyst; completely operable system; produces usable by-products (gas, hot coke); recovery of coke precursors in coal liquids as salable product; higher thermal efficiency; and better quality final products.

The fluid coking utilized in my invention are well known to those skilled in the art. Fluid coking basically upgrades a wide range of low-value residual stocks to naphtha, middle distillates, catalytic cracking feed stock, and by-product gas and coke. A description of the fluid coking process including the particular parameters (temperature, pressure, type of feedstocks, size of vessel, etc.) may be found in any petroleum refining book or publication (e.g. Petroleum Refiner, Vol 39, No. 5, May 1960, pp 157–160; Hydrocarbon Processing, Sept. 1970, pp 181).

Typically, the major products from this process are char, and a high yield of coal tars which include between about 10 and 80 carbon atoms and are predominantly 2-8 attached ring polynuclear aromatics. The constituency of coal tar is well known to those skilled in the art and may be found in such references as The Handbook of Chemistry and Physics, 48th Edition, published by the Chemical Rubber Co. (see page C-12).

The hydrogen used in the process can be obtained from any commercial source, such as char gasification, naphtha and/or methane steam reforming, or cracking of ethane to produce ethylene. The steps of producing, storing, heating, cooling and recycling the hydrogen are well known and need not be discussed here. Reactor design, though an important consideration in terms of economics, is not an essential part of this invention. Any reactor design that will allow for the fast heat-up of the feed carbonaceous material, a short reaction time, and a fast quench of the product stream can be used for the invention.

My invention will be illustrated by the following set forth examples which are given by way of illustration and not by any limitations. All parameters such as concentrations, mixing proportions, temperatures, pressures, rates, compounds, etc., submitted in these examples are not to be construed to unduly limit the scope of my improved process for producing and upgrading carbonaceous tars.

EXAMPLE 1

Illinois No 6 (HvbC), VM MF 36.6%, Ash MF 10.8% Fix. C MF 52.6, ground to 50×100 mesh (U.S. Sieve), was fed to a hydrogenation reactor. The coal assayed 71.2%C, 4.8%H, 1.4%N, 2.9%S, 9.5%O, on moisture-ash-free (MAF) basis. The reactor conditions were 5 psia, 1700° F, $H_2$ Conc. % 98, Heating rate 160,000° F/SEC, Quench Temp. 1000° F, $H_2$/Coal, (lb/lb.)1.0, Heat-up Time. (sec.) 0.010, Reaction Time, (sec.) 0.900, and Quench Time (Sec.) 0.020.

Processing and analysis of the reactor effluent, neglecting excess $H_2$ and char, gave these results:

| | |
|---|---|
| C | 80.5 wt. % |
| H | 7.0 |
| N | 1.2 |
| S | 2.0 |
| O | 9.2 |
| Con Carbon | 20 wt. % |
| API Gr. | −4 |
| Pour Pt. ° F | 115 |
| Viscosity, SSU | 1330 |
| HHV, Btu/lb. | 15050 |
| Metals, ppm | 660 |
| AST Moist, ° F | |
| IBP | 450 |
| 50% | 900 |
| E.P./% Rec. | 1100/60% |
| Tar Yield, bbl/ton MAF | 3.3 |

Coal tar was then processed in a fluid coker operating at 2 psig, 1000° F 1.0 steam/tar ratio and yielded per bbl of coal tar fed:

73 lb. coke
400 SCF 500 Btu gas after gas cleanup
0.84 Bbl of oil with following assay:

| | | |
|---|---|---|
| API gravity | = | 10 |
| Conradson Carbon | = | 0.9% |
| Metals content | = | 65 ppm |
| Viscosity | = | 100 ssu |
| Pour Pt. | = | 80° F |
| ASTM Dist. ° F | | |
| IBP | = | 250 |
| 50% | | 700 |
| EP/% Dist. | | 850/88 |

EXAMPLE 2

Colorado A (HvbB), VM MF 36.8%, Ash MF 8.1%, Fix C MF 55.1, ground to 40×200 mesh (U.S. Sieve), was fed to a hydrogenation reactor. The coal assayed 73.5%C, 5.1%H, 1.6%N, 0.7%S, 11.0%O, on moisture-ash free (MAF) basis. The reactor conditions were 25 psia, 1900° F, $H_2$ Conc. % 90, Heating rate 120,000° F/SEC, Quench Temp. 1050° F, $H_2$/Coal, (lb/lb.) 0.50, Heat-up Time, (sec.) 0.015, Reaction Time (sec.) 0.500, and Quench Time (sec.) 0.010.

Processing and analysis of the reactor effluent, neglecting excess $H_2$ and char, gave these results:

| | |
|---|---|
| C | 83.6 wt. % |
| H | 8.3 |
| N | 1.1 |
| S | 0.4 |
| O | 6.6 |
| Con Carbon | 12 wt. % |
| API Gr. | −4 |
| Pour Pt. ° F | 108 |
| Viscosity, SSU | 1090 |
| HHV, Btu/lb. | 16000 |
| Metals, ppm | 350 |
| AST Moist, ° F | |
| IBP | 460 |
| 50% | 920 |
| E.P./% Rec. | 980/58% |
| Tar Yield, bbl/ton MAF | 3.0 |

Coal tar was then processed in a fluid coker operated at 20 psia, 1050° F, 2.0 steam/tar ratio and yielded per bbl. of coal tar fed:

42 lb coke
1000 SCF 300 Btu gas after gas cleanup
0.90 Bbl of oil with the following assay:

| | | |
|---|---|---|
| API Gravity | = | 15° |
| Conradson Carbon | = | 0.7% |
| Metals | = | 35 ppm |
| Viscosity | = | 75 SSU |
| ASTM Dist. ° F | | |
| IBP | = | 195 |
| 50% | = | 700 |
| EP/% Dist. | = | 885/92% |

EXAMPLE 3

Utah Hiawatha (HvbB), VM MF 42.5%, Ash MF 5.0%, Fix C MF 52.5 ground to 20×235 mesh (U.S. Sieve), was fed to a hydrogenation reactor. The coal assayed 77.1%C, 6.2%H, 1.4%N, 0.5%S, 9.8%O, on moisture-ash-free (MAF) basis. The reactor conditions were 10 psia, 1500° F, $H_2$ Conc. % 85, Heating rate 70,000° F/SEC, Quench Temp. 1,100° F, $H_2$/Coal, (lb/lb.) 2.0, Heat-up Time, (sec.) 0.020, Reaction Time, (sec.) 0.100, and Quench Time (sec.) 0.100.

Processing and analysis of the reactor effluent, neglecting excess $H_2$ and char, gave these results:

| | |
|---|---|
| C | 83.7 wt. % |
| H | 8.6 |
| N | 1.0 |
| S | 0.2 |
| O | 6.5 |
| Conradson Carbon | 11.5% |
| API Gr. | −3 |
| Pour Pt. ° F | 130 |
| Viscosity, SSU | 390 |
| HHV, Btu,/lb. | 16500 |
| Metals, ppm | 190 |
| IBP | |
| 50% | 658 |
| E.P./% Rec. | 720/88% |
| Tar Yield, bbl/ton MAF | 3.0 |

Coal tar was then processed in a fluid coker operated at 5 psig, 1,100° F, 0.8 steam/tar ratio and yielded per bbl of coal tar fed:

44 lb coke

400 SCF 400 Btu gas after gas cleanup 0.93 Bbl of oil with following assay:

| | | |
|---|---|---|
| API gravity | = | 12.0 |
| Conradson Carbon | = | 0.2% |
| Metals | = | 70 ppm |
| Viscosity | = | 50 SSU |
| ASTM Dist. ° F | | |
| IBP | = | 150 |
| 50% | = | 500 |
| EP/% Rec | = | 720/99% |

EXAMPLE 4

Wyoming Big Horn (Sub.B), VM MF 33.9%. Ash MF 18.8%, Fix. C MF 47.3, ground to −200 mesh (U.S. Sieve), was fed to a hydrogenation reactor. The coal assayed 77.1%C, 6.2%H, 1.4%N, 0.5%S, 9.8%O, on moisture-ash-free (MAF) basis. The reactor conditions were 250 psia, 2250° F, $H_2$ Conc. % 80, Heating rate 430,000° F/SEC, Quench Temp. 900° F, $H_2$/Coal, (lb/lb.) 3.0, Heat-up Time, (sec.) 0.005, Reaction Time, (sec.) 0.050, and Quench Time (sec.) 0.005.

Processing and analysis of the reactor effluent, neglecting excess $H_2$ and char, gave these results:

| | |
|---|---|
| C | 82.7 wt. % |
| H | 8.0 |
| N | 1.0 |
| S | 0.6 |
| O | 7.5 |
| Conradson Carbon | 5 wt. % |
| API Gr. | −4 |
| Pour Pt. ° F | 120 |
| Viscosity, SSU | 228 |
| HHV, Btu/lb. | 15100 |
| Metals, ppm | 100 |
| AST Moist, ° F | |
| IBP | 425 |
| 50% | 820 |
| E.P./% Rec. | 850/52% |
| Tar Yield, bbl/ton MAF | 2.5 |

Coal tar was then processed in a fluid coker operated at 1 psig, 900° F, 2.0 steam/tar ratio and yielded per bbl. of coal tar fed:

19 lb coke

1400 SCF 300 Btu gas after gas cleanup 0.94 Bbl of oil with following assay:

| | | |
|---|---|---|
| API Gravity | = | 20° |
| Conradson Carbon | = | 0.05% |

-continued

| | | |
|---|---|---|
| Metals | = | 10 ppm |
| Viscosity | = | 25 SSU |
| ASTM Dist. ° F | | |
| IBP | = | 125 |
| 50% | = | 490 |
| EP/% Rec | = | 820/98% |

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A process of producing and upgrading carbonaceous tars comprising, in serial combination, a. adding liquid or crushed solid carbonaceous material to a reactor, b. adding hot hydrogen to the stream of carbonaceous material, c. reacting the hydrogen and the carbonaceous material at a pressure between atmospheric pressure and 250 psia. and a temperature between about 400° and about 2,000° C, d. quenching the mixture, with the total residence time for heat-up, reaction and quenching varying from about 2 milliseconds to about 2 seconds, e. processing said quenched reaction mixture to form a cold tar stream, and f. introducing said cold tar stream of step (e) into a fluid coking zone to obtain gas, upgraded carbonaceous tars, and hot coke.

2. The process of claim 1, wherein the crushed solid material has an average particle size smaller than about one-half inch.

3. The process of claim 1, wherein the ratio of hydrogen to carbonaceous material, in the carbonaceous material-hydrogen mixture, varies from about 0.05 to about 4.

4. The process of claim 1, wherein the heat-up time of said carbonaceous material is between about 500° C/sec. and 1,000,000° C/sec.

5. The process of claim 1, wherein the temperature of the quenched mixture does not exceed about 1200° C.

6. The process of claim 1, wherein the quenching material is hydrogen and the carbonaceous material is coal.

7. A method of producing and upgrading coal tars comprising:

a. introducing finely divided coal into a vessel in a continuous stream, said vessel having a pressure between atmospheric pressure and 250 psia;

b. continuously adding hot hydrogen to the vessel so as to impinge said coal stream;

c. maintaining said coal stream within said vessel at a temperature between about 400° and about 2,000° C.

d. limiting the total residence time for heat-up, reaction and quenching to between about 2 milliseconds to about 2 seconds;

e. thereafter quenching the hot hydrogen-coal stream with cold hydrogen, f. separating coal tars from said quenched hydrogen-coal stream, and g. introducing said coal tars of step (f) directly into a fluid coking zone to obtain gas, upgraded coal tars, and hot coke.

8. The method of claim 7, wherein a. the coal has an average particle size of less than about ½ inch, b. the hydrogen/coal weight ratio of the reaction mixture varies from about 0.005 to about 4, c. the reaction temperature varies from about 500°, to about 1,500° C., d. the total residence time of hydrogen and coal is not more than about 1 second, e. the cold hydrogen quench stream has a temperature below 1,200° C., and f. the separated liquid hydrocarbon stream is further processed.

9. The method of claim 7, wherein the separated coal tars are further processed, said coal tars having compounds which include between about 10 and 80 carbon atoms.

* * * * *